US006331018B1

(12) United States Patent
Roth et al.

(10) Patent No.: US 6,331,018 B1
(45) Date of Patent: Dec. 18, 2001

(54) LABEL SHEET

(75) Inventors: Joseph D. Roth, Springboro, OH (US); Wayne D. Finster, Viroqua, WI (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/343,995

(22) Filed: Jun. 30, 1999

(51) Int. Cl.[7] ..... B65D 27/06

(52) U.S. Cl. ..... 283/81; 283/56; 283/67; 428/195

(58) Field of Search ..... 283/56, 81, 67; 428/195

(56) References Cited

U.S. PATENT DOCUMENTS

| | | | | |
|---|---|---|---|---|
| 4,460,371 | | 7/1984 | Abber . | |
| 4,647,504 | | 3/1987 | Kimimura et al. . | |
| 5,100,976 | | 3/1992 | Hamada et al. . | |
| 5,328,208 | | 7/1994 | Garrison . | |
| 5,350,612 | * | 9/1994 | Stern et al. | 428/40 |
| 5,482,988 | | 1/1996 | Ulman et al. . | |
| 5,489,624 | | 2/1996 | Kantner et al. . | |
| 5,501,393 | * | 3/1996 | Walz | 229/300 |
| 5,512,612 | | 4/1996 | Brown et al. . | |
| 5,521,002 | * | 5/1996 | Sneed | 428/195 |
| 5,580,640 | | 12/1996 | Kraft et al. . | |
| 5,716,701 | | 2/1998 | Skoglund et al. . | |
| 5,884,944 | * | 3/1999 | Durham | 283/67 |

OTHER PUBLICATIONS

Wallace News & Highlights—New Product Annoucements, http://www.wallace.com/news/newproducts/asp, May 13, 1999, pp. 1–2.

Rhodia, Inc., "UV–Silicone Cure System", Mar. 9, 1998, 7 pages.

Co–pending Applicatiion Serial No. 09/151,000; filed Sep. 10, 1998, by inventor Joseph D. Roth et al., entitled "Selective Release Label Sheet", assigned to NCR Corporation.

Co–pending Application Serial No. 09/114,434; filed Jul. 13, 1998, by inventor Joseph D. Roth et al., entitled "Label Sheet", assigned to NCR Corporation.

* cited by examiner

*Primary Examiner*—Willmon Fridie, Jr.
*Assistant Examiner*—Mark T. Henderson
(74) *Attorney, Agent, or Firm*—Millen White Zelano & Branigan PC

(57) ABSTRACT

A liner for a label sheet has a printed image under the release layer and an opaque ink receptive coating on the opposite side thereof with a printed image thereon. Label sheets with this liner further include an overlay having at least one label cut therethrough which is aligned with the release layer of the liner and an adhesive layer which bonds the overlay and liner. The label sheet can be part of a form/label combination where the overlay includes the portion that is not adhered to the liner.

8 Claims, 4 Drawing Sheets

LABEL SHEET

FIELD OF THE INVENTION

The present invention relates to liners for laminated label sheets and form/label combinations which contain them.

BACKGROUND OF THE INVENTION

Label sheets are commonly available in various configurations with and without printing thereon. A typical label sheet is a laminate of a paper overlay and an underlying release liner. An adhesive bonds the overlay to the liner in the finished article.

In typical use, information is printed on top of the overlay, and the overlay is then removed from the liner by being peeled therefrom. The peeled away label has exposed adhesive so that it may be pressed against paper or other object for attachment thereto. A typical release liner is coated over one side with liquid silicone to provide a low adhesion surface upon which the overlay is temporarily bonded. The adhesive provides a weak bond between the overlay and the silicone liner which maintains the laminate together until it is desired to remove the overlay from the liner.

More complex label sheets include several labels or decals in the overlay defined by respective perimeter die-cuts which allow removal of individual labels from the liner. The individual labels may be directly adjacent to each other or there may be an intervening label rim or border which remains attached to the liner after the individual labels are peeled away.

A further increase in complexity of the label sheet includes an integral paper form attached to the label portion of the overlay which does not overlie the liner. This type of label sheet may be manufactured using a lap joining method wherein the label and liner laminate is pre-manufactured and lap joined along an edge thereof to the paper form. In another integrated method of manufacture, the entire overlay, including the label and form portions thereof, is separately manufactured in a common sheet and the liner is then bonded below the label portion thereof.

These various label sheets nevertheless use a commonly fabricated release liner which is typically manufactured in large rolls with the silicone in liquid form being applied over the entire surface of the liner paper which is then thermally cured. The large roll of release liner is then cut into individual smaller rolls for use in various label sheet applications as required.

Since the liner is typically manufactured in large rolls, cut to size, and used for various applications, it is not practical or even possible to provide printing on top of the liner and below the silicone surface. This leaves only the front and back sides of the overlay and the back side of the liner as available surfaces for printing, and therefore decreases the potential efficiency of the label sheet. Co-pending application Ser. No. 09/114,434, filed Jul. 13, 1998 addresses this limitation by providing label sheets and form/label combinations wherein a release layer can be formed directly on the liner surface after lamination which permits printing in advance of formation of the release layer.

A problem associated with printing under the release layer is that the print can be seen through the liner. This makes it difficult to read material printed on the back of the liner. This is particularly a problem where variable information is printed on the back of the liner since the location and size of such print can not be predicted with certainty making it difficult to anticipate where images can be applied under the release layer without interference. Another problem associated with printing variable information on the back side of the liner is that many inks do not adhere to the unsiliconized surfaces of the liner. This is especially true for toners used in laser printers and copiers. The highly calendared papers used for liners must be treated with a clear ink receptive coating to accept print.

BRIEF DESCRIPTION OF THE DRAWING invention, in accordance with preferred and exemplary embodiments, together with further objects and advantages thereof, is described in the following summary taken in conjunction with the accompanying drawings in which.

SUMMARY OF THE INVENTION

It has been discovered that an opaque ink receptive varnish applied to the back side of the liner will solve the problem of interference caused by printed images under the release layer and will also improve the adhesion of inks used to apply variable information without disrupting the structure of the label sheet. Accordingly, the present invention provides a liner having a front side with a high adhesion surface capable of having an adhesive adhered thereto, a portion of which has print thereon and is covered by a release layer having a low adhesion surface. The liner also has an opaque ink receptive coating positioned on the back side thereof with printing thereon, wherein the opaque ink receptive coating is sufficiently dense to permit printing thereon to be viewed without interference from the printing on the front side of said liner.

The invention also provides a label sheet comprising an overlay having at least one label cut therein wherein the overlay has a front side capable of receiving print and a rear side with a high adhesion surface capable of having adhesive bonded thereto. The label sheet also comprises a liner having a front side with a high adhesion surface capable of having an adhesive bonded thereto, a portion of which has printing thereon and is covered by a release layer having a low adhesion surface. This liner also has an opaque ink receptive coating position on the back side thereof. The overlay and liner are bonded together by an adhesive layer which bonds the back side of said overlay to the front side of said liner. The liner and overlay are aligned such that the labels cut in the overlay overlap the release layer on the front side of the liner such that the labels can be easily separated from the label sheet.

The invention also provides form/label combinations having such a label sheet incorporated therein.

Figure 5:
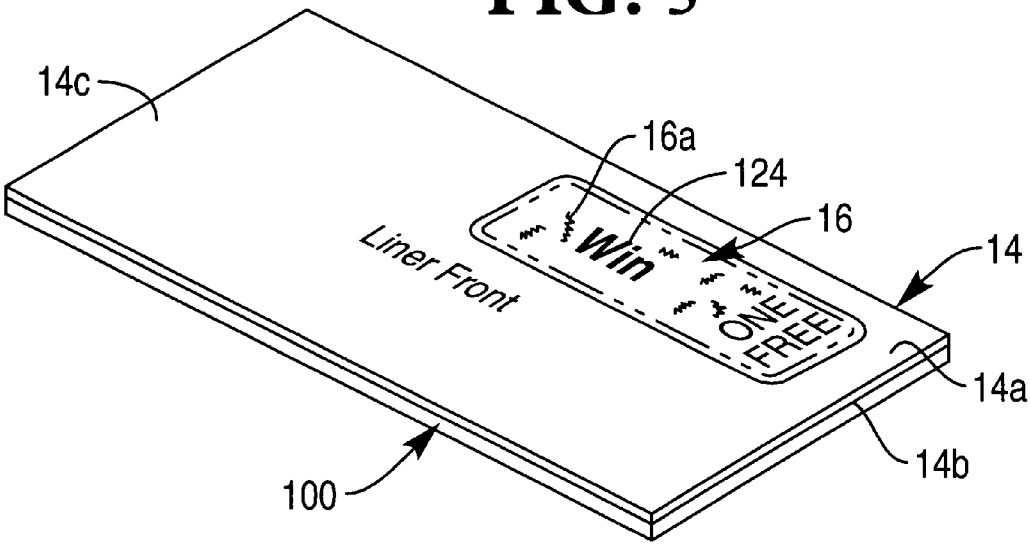
FIG. 5 is an isometric view of the front side of a liner in accordance with an embodiment of the present invention.

Illustrated in FIG. 5 is a liner 14 in accordance with the present invention having a front side 14*a* and a back side 14*b*. Front side 14*a* as a high adhesion surface capable of having an adhesive bonded thereto. Print 124 is positioned on front surface 14*a* and is covered by release layer 16, preferably comprised of silicone, having a low adhesion surface 16*a*. An opaque ink receptive layer 100 is positioned on the back side 14*b* of liner 14. The liner 14 and release layer 16 can be comprised of materials conventionally used in the art. The opaque ink receptive layer can be prepared from conventional pigmented varnishes. Water based white pigmented varnish is preferred, however, all colors are suitable, provided the density of the layer formed is sufficiently high to prevent the image on the other side of the liner from showing through.

While distortion of the image on back side 14*b* of liner 14 is of concern, the opaque ink receptive layer will also prevent distortion of the printed image which appears under the release layer.

The liners of this invention can be employed in the label sheets and form/label combinations of this invention described more particularly below.

Figure 1:
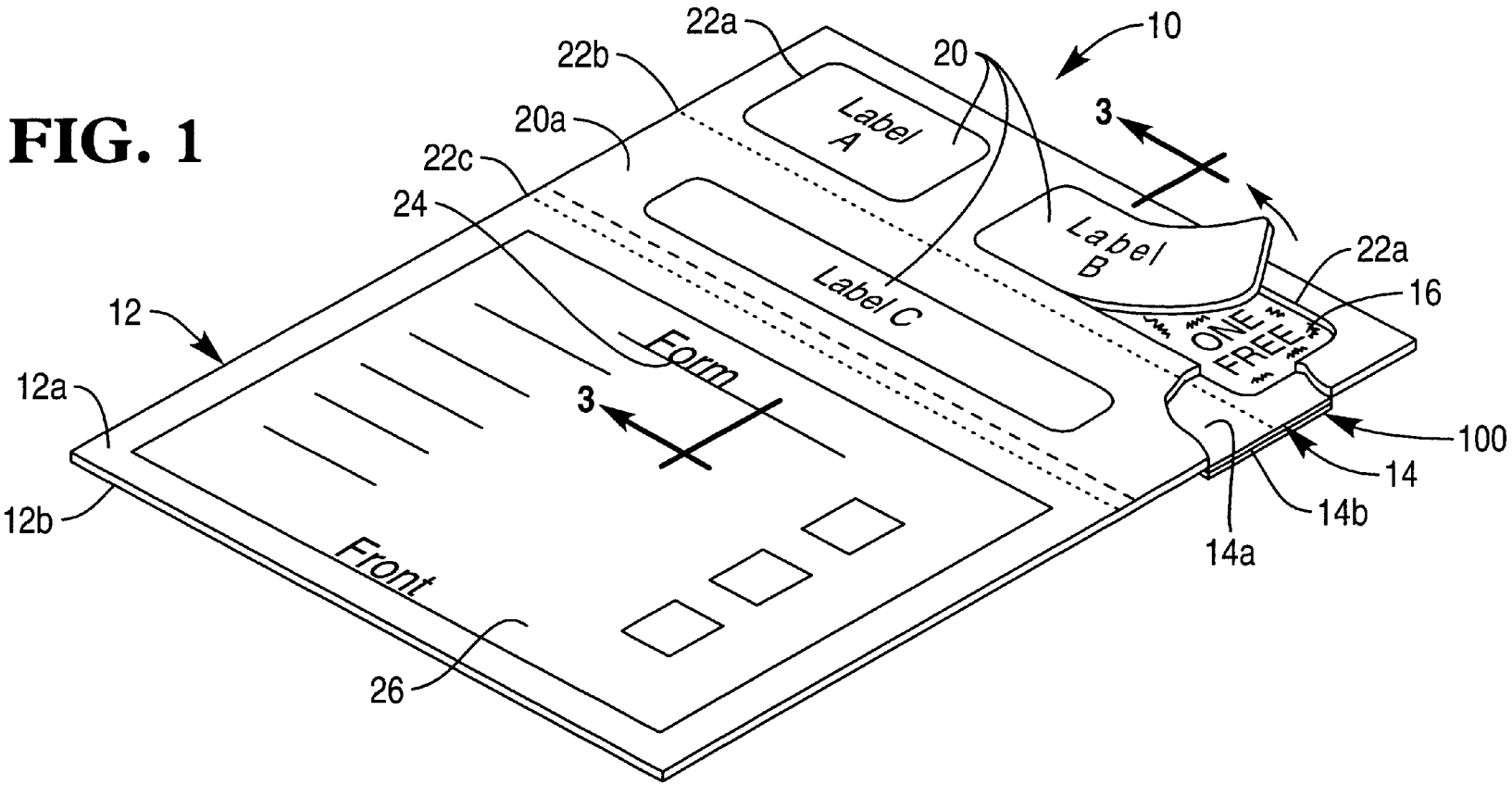
FIG. 1 is an isometric view of the front side of a label sheet in accordance with an exemplary embodiment of the present invention.
Figure 2:
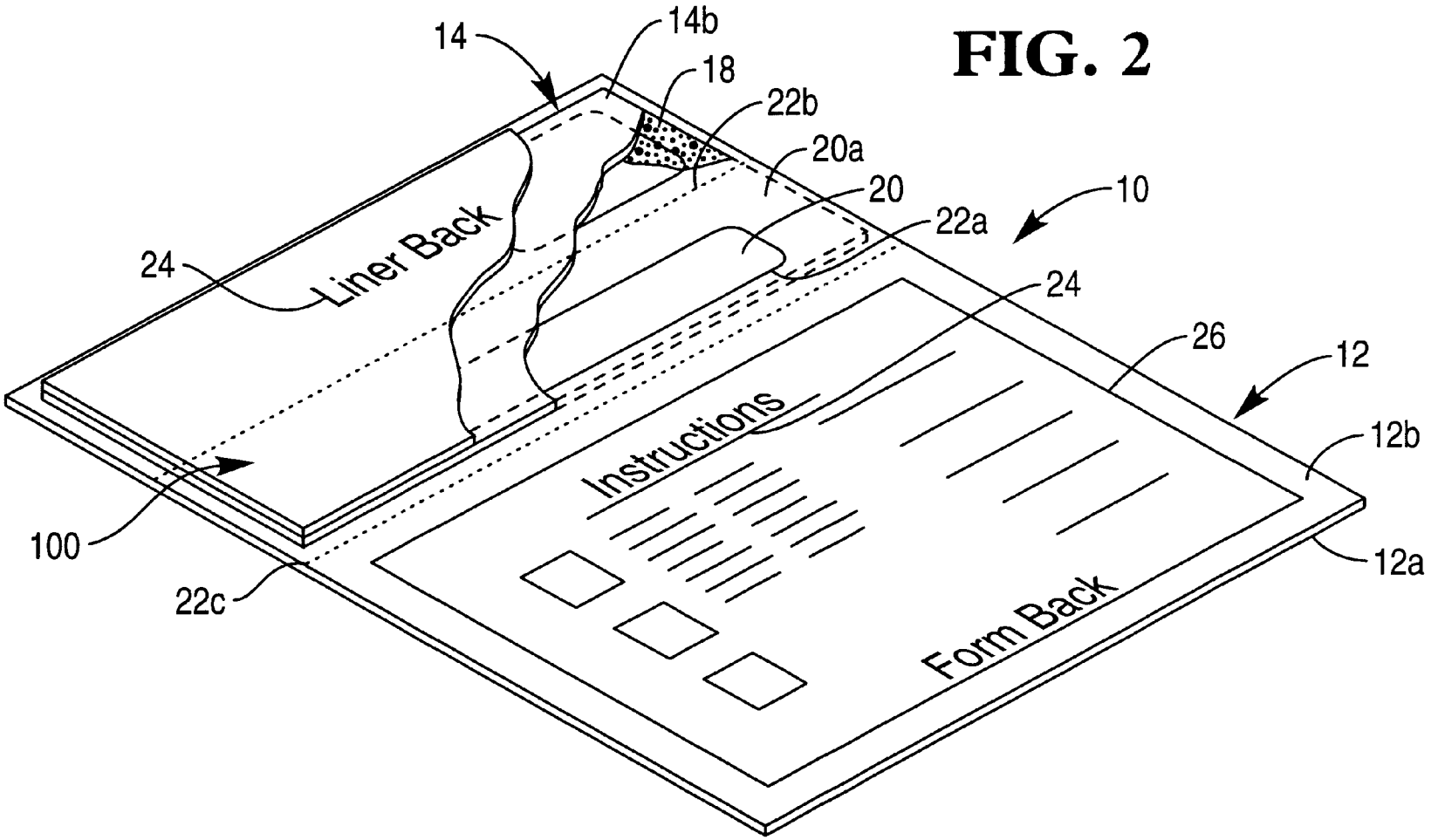
FIG. 2 is an isometric view of the back side of the label sheet illustrated in FIG. 1.

Illustrated in FIGS. 1 and 2 is a label sheet or laminate 10 in accordance with an exemplary embodiment of the present invention. Label sheet 10 includes an overlay 12 having a front side 12*a* and a back side 12*b*.

The overlay is laminated to an underlying release liner 14 which includes a front side 14*a* which faces the overlay back side 12*b*, and a back side 14*b*. The overlay 12 is illustrated in sectional view in FIG. 3 laminated to the liner 14, with the liner 14 being shown in isolation in FIG. 4.

Figure 4:
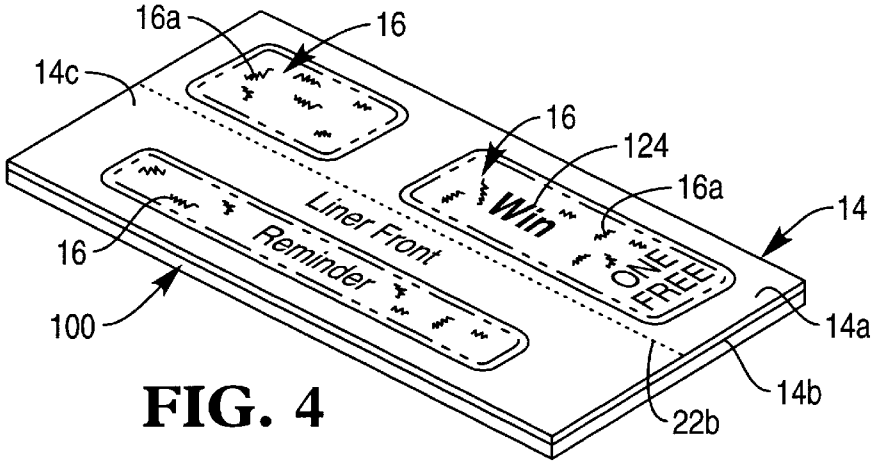
FIG. 4 is an isometric view of the front side of the liner illustrated in FIG. 3 and taken along line 4—4.

In accordance with the present invention, the liner 14 illustrated in the exemplary embodiment in FIG. 4 includes both a relatively low adhesion surface 16*a* formed, for example, by applying release layer 16 to a selected portion of the liner front 14*a*, and a relatively high adhesion surface 14*c* which may simply be the remaining, exposed rim or border portion of the liner front side 14*a* after application of the silicone or a special coating. The liner 14 may be made of any suitable material such as paper, for example, which can be locally coated with the release layer 16 as described in co-pending application Ser. No. 09/114,434, filed Jul. 3, 1998. Opaque ink receptive layer 100 is deposited on liner back side 14*b* but can be selectively deposited over portions which are aligned with release layer 16 by conventional flexographic printing techniques. FIGS. 1 and 2 illustrate a portion of the opaque ink receptive layer 100. FIG. 2 shows the opaque ink receptive layer with printed image 24 thereon. Such print is preferably text of variable information applied by conventional printers such as laser, ink jet, impact and thermal transfer printers.

Figure 3:
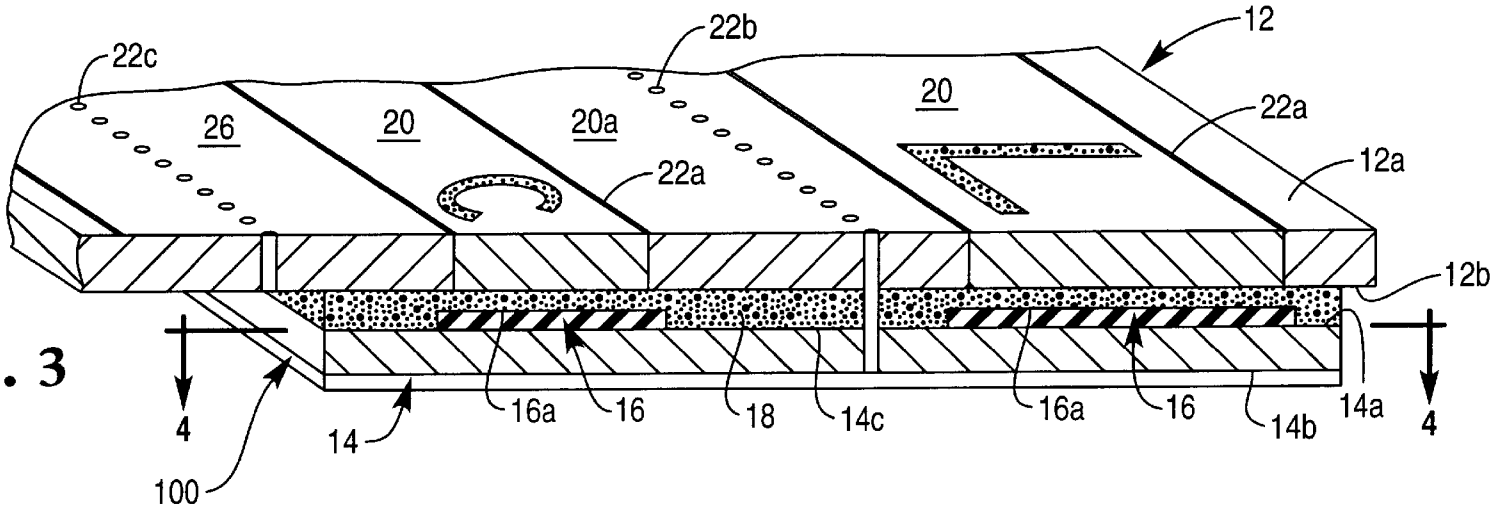
FIG. 3 is a sectional view through a portion of the label sheet illustrated in FIG. 1 and taken along line 3—3.

As shown in FIGS. 2 and 3, an adhesive 18 is used to bond together overlay 12 and liner 14. The adhesive 18 is permanently bonded to the overlay back side 12*b* and covers the entire liner front side 14*a*, and may have any conventional composition to form a weak bond over the low adhesion surface 16*a* and a substantially permanent bond over the high adhesion surface 14*c*. In this way, the overlay 12 is intimately bonded to the liner 14 over the liner's entire front surface 14*a* except at the selected low adhesion surfaces 16*a*. This prevents the unintended separation of the overlay from the liner at high adhesion surface 14*c* while allowing peeling separation of the overlay at the local regions of the low adhesion surfaces 16*a*.

As shown in FIGS. 1 and 2, the overlay 12 may include one or more decals or labels 20 having any suitable configuration or shape. The overlay may include one label laminated over the entire liner 14, or a plurality of individual labels either directly adjoining each other or separated by a remaining label border 20*a*. The individual labels or decals 20 may be blank, or printed with numerals, letters, or graphics.

Referring again to FIG. 4, the low adhesion surface 16*a* is defined by a patch or spot of release layer 16, preferably of silicone, which generally matches the corresponding configurations of the individual labels such as the rectangles illustrated. High adhesion surface 14*c* surrounds the several spots 16*a* along the entire perimeters thereof. In this configuration, the liner 14 includes a plurality of the spots 16*a* which correspond with the respective labels 20 for allowing individual removal or peeling of the labels. As shown in FIG. 3, the label border 20*a* is strongly or permanently bonded to the high adhesion surface 14*c* forming a liner border.

As shown in FIGS. 1 and 2, the overlay 12 may include one or more cleaved separation joints, designated by the prefix 22, which may be conveniently used for separating the overlay. A first form of the separation joint is a conventional die-cut 22*a* which surrounds the individual labels 20 along the perimeters thereof in a substantially continuous cut for allowing easy removal of the individual labels from the top of liner 14.

As shown in FIG. 3, the die-cuts 22*a* are preferably disposed atop the respective silicone spots 16 closely adjoining the high adhesion surface 14*c*. In this way, individual labels 20 may be peeled away from the liner as illustrated by the partially removed label B in FIG. 1 which separates along the die-cut 22*a*, with the surrounding label border 20*a* remaining securely bonded to the underlying liner 14. This prevents separation of the label border 20*a* and eliminates the problem of exposed adhesive therefrom which could otherwise jam a laser printer for example. Furthermore, the secure bonding of the label border 20*a* to the underlying liner prevents squeeze out of the adhesive when passed through the hot fusion rollers in the laser printer.

As initially shown in FIGS. 4 and 5, the liner 14 also includes inked printing 124 in any form such as letters, numerals, and graphics atop the liner front 14*a* under release layer 16 and on the opaque ink receptive layer 100. The release layers 16 are applied in an extremely thin layer and preferably have a clear or transparent composition for viewing the printing underneath. In view of the manufacturing process described in the co-pending application, printing atop the liner front 14*a* may now be accomplished prior to the application of the silicon spots 16. It is possible to provide printing under the release layer 16 according to the procedures described in co-pending U.S. patent application Ser. No. 09/114,434, filed Jul. 3, 1998.

In the embodiments illustrated in FIGS. 1 and 2, the overlay 12 and the liner 14 include printing 24 on the overlay front side 12*a*, the liner front side 14*a* and the opaque ink receptive layer 100. The printing on liner front side 14*a* becomes visible upon removal of the individual labels and may provide any useful information or promotions thereunder. Since the liner front 14*a* and back 14*b*, coated with ink reception layer 100, are available for printing, compression of the entire label sheet 10 may be affected to contain the same amount of information in a reduced size. This reduces both the amount of material required in manufacturing the label sheet 10 as well as reducing its cost.

The printing under the release layer 16 is extremely difficult to modify because it is protected by the overlying silicone. This printing is therefore secure from adulteration and may be used for various security purposes not otherwise available in conventional label sheets. Furthermore, the printing below the release layer 16 is also protected from chemical and mechanical degradation or attack and substantially increases the longevity of the printing thereunder.

As shown in FIGS. 1 and 2, a second form of the separation joint, which is optional, may include a plurality of perforations or micro-perforations 22*b* which are disposed linearly across the label border 20*a*, and extend through both the overlay 12 and the liner 14, and through the adhesive.

As shown in more detail in FIG. 3, the optional perforations 22*b* are disposed atop the high adhesion surface 14*c* in a path straddling the perforations to define a skip devoid of the silicone. This allows the label and liner to be torn along the tear. The strong adhesive bond along the optional perforations 22*b* maintains the integrity of the label/liner joint while permitting the separation along the perforations. This also prevents the inadvertent exposure of adhesive at the torn edges which could inadvertently attach to other papers.

As shown in FIGS. 1 and 2, the overlay 12 may also include a form 26 in the exemplary configuration of the paper sheet extending integrally from the label border 20*a* to providing a form/label sheet combination. Liner 14 underlies solely the labels and border and not the form 26. In a preferred embodiment, the entire overlay 12 is a single sheet of paper having portions thereof defining the individual labels 20, the label border 20*a*, and the form 26. The form 26 may have any suitable configuration and may be blank or printed with various information as desired.

Also, if desired, the overlay may additionally include a third form of separation having a plurality of optional perforations 22*c* disposed linearly across the form 26 adjacent the label border 20*a* as illustrated in FIGS. 1 and 2. As shown in FIG. 3, the optional form perforations 22*c* extend solely through the form 26 since the liner 14 terminates short thereof for allowing the form 26 to be separated from the labels and rim as desired.

Overlay 12 is preferably a base sheet conventionally used in business forms and is typically a commercially available paper, but can include specialty papers and other cellulosic material such as cardboard or synthetic polymer materials. This includes individual paper sheets as well as continuous paper rolls and continuous paper fanfolds or similar continuous folding arrangements for paper. The paper can also be part of a multi-page form. The paper can be coated or uncoated; however, the front face 12*a* must be suitable for printing and rear face 12*b* must be suitable for adhesion of an adhesive, preferably a pressure-sensitive adhesive. The overlay 12 is preferably sufficiently thick to provide strength such that labels can be cut and removed in one piece and printing can be performed on front face 12*a*.

Adhesive 18 can be a conventional pressure-sensitive adhesive used for labels. These include adhesives based on silicone resins, ethyl vinyl acetate copolymers, polyurethanes, polychloroprenes, polybutadienes, butadiene acrylonitrile rubbers, natural rubbers, styrene butadiene rubbers, acrylics, polyisobutylenes, butyl rubbers, higher polyvinyl alkyl ethers, S-B-S block copolymers, polyacrylate esters, vinyl ethers, styrene-isoprene butadiene acrylonitrile polymers. Preferred pressure-sensitive adhesives include hot melt pressure-sensitive adhesives. The pressure sensitive adhesive can be U.V. curable where desired. Effective hot-melt, silicone resin-based, pressure-sensitive adhesives are described in U.S. Pat. No. 5,482,988. Solvent-based pressure-sensitive adhesives, as well as water-borne adhesives, are suitable as well. Suitable solvent-based silicon resin, pressure-sensitive adhesives include those described in U.S. Pat. Nos. 4,460,371 and 5,100,976. U.S. Pat. No. 5,489,624 describes suitable hydrophilic polyethylene oxide-based pressure-sensitive adhesives. U.S. Pat. No. 4,647,504 describes suitable adhesive dispersions based on methylacrylate, styrene and methacrylate polymers. U.S. Pat. No. 5,512,612 describes suitable water dispersible, poly(alkoxyalkyl)acrylate polymers and U.S. Pat. No. 5,716,701 describes suitable acrylic copolymer emulsions.

The amount of the pressure-sensitive adhesive employed (coat weight) is preferably consistent with that employed in conventional labels. The viscosity of the adhesive also preferably conforms to conventional adhesives used in labels so that adhesive does not leak through the die cut or perforations.

Release layer 16 can comprise a solid silicone layer that is a U.V. cured or electron beam cured and is preferably a cationically U.V. cured or electron beam cured silicon resin.

The labels 20 are defined within overlay 12 by either a die cut or perforation within the base sheet to enable easy removal. Perforations can be accomplished either before or after lamination with the liner 14. Where the labels are die cut before lamination, means for securing them must be provided. Overlay 12 may include more than one label defined by a die cut or perforation.

The single label sheet 10 disclosed above combines various improvements thereof for clarity of presentation.

The liners, label sheets and forms/label combinations of this invention can be prepared using conventional equipment for printing images 124, applying release layers 16, applying adhesives 18, laminating overlays 12 and liners 14, and cleaving these laminations to form die cuts 22*a* and perforations 22*b* and 22*c* therein.

The entire disclosure of all applications, patents and publications, cited above and below, and of corresponding U.S. application Ser. No. 09/114,434, filed Jul. 3, 1998 are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A label sheet comprising a) an overlay having at least one label cut therethrough, said overlay having a front side capable of receiving print and a rear side with a high adhesion surface capable of having an adhesive bonded thereto, b) a liner comprising i) a front side having a high adhesion surface capable of having an adhesive bonded thereto and a printed image positioned on a portion thereof which is covered low adhesion surface, and ii) a backside with both an opaque ink receptive coating and a printed image positioned thereon, wherein the opaque ink receptive coating is aligned with the printed image positioned on the front side of said liner and the printed image on the back side of said liner is positioned on said opaque ink receptive coating, and an adhesive layer which bonds the rear side of said overlay to the front side of said liner, wherein the liner and overlay are aligned such that the labels cut in the overlay overlap the release layer on the front side of said liner.

2. A label sheet as in claim 1 wherein said opaque ink receptive coating covers the entire back side of said liner.

3. A label sheet as in claim 1 wherein said opaque ink receptive coating is aligned with the release layer positioned on the front side of said liner.

4. A label sheet as in claim 1 wherein the printed image on said opaque ink receptive coating comprises text of variable information.

5. A label sheet as in claim 1 wherein the opaque ink receptive coating is white in color.

6. A label sheet as in claim 1 wherein the opaque ink receptive coating is a color other than white.

7. A label sheet according to claim 1 which is part of a form/label combination and said overlay further includes a portion which is not adhered to said liner.

8. A sheet according to claim 1 wherein said release layer is transparent for viewing the printed image on the front side of said liner.

* * * * *

UNITED STATES PATENT AND TRADEMARK OFFICE

CERTIFICATE OF CORRECTION

PATENT NO. : 6,331,018 B1
DATED : December 18, 2001
INVENTOR(S) : Roth, J. D. and Finster, W.

It is certified that error appears in the above-identified patent and that said Letters Patent is hereby corrected as shown below:

Column 6,
Line 48, after "covered" insert -- by a release layer having a --.
Line 56, before "an" insert -- c) --.

Signed and Sealed this

Second Day of July, 2002

*Attest:*

*Attesting Officer*

JAMES E. ROGAN
*Director of the United States Patent and Trademark Office*